United States Patent [19]

Holdener

[11] Patent Number: 4,697,698

[45] Date of Patent: Oct. 6, 1987

[54] CREDIT AND IDENTIFICATION CARD HOLDER

[76] Inventor: Franz Holdener, Neuseewen, CH-8843 Oberiberg, Switzerland

[21] Appl. No.: 804,659

[22] PCT Filed: Feb. 15, 1985

[86] PCT No.: PCT/CH85/00028

§ 371 Date: Nov. 13, 1985

§ 102(e) Date: Nov. 13, 1985

[87] PCT Pub. No.: WO85/04313

PCT Pub. Date: Oct. 10, 1985

[30] Foreign Application Priority Data

Mar. 28, 1984 [CH] Switzerland ..... 1556/84

[51] Int. Cl.[4] ..... A45C 11/00

[52] U.S. Cl. ..... 206/39.4; 206/37; 206/37.2; 206/37.5; 40/16; 40/16.4

[58] Field of Search ..... 206/37, 38, 39, 39.1, 206/39.4, 39.6, 37.2, 37.5; 150/147, 148; 40/16, 16.4, 17, 18

[56] References Cited

U.S. PATENT DOCUMENTS

| | | | |
|---|---|---|---|
| 493,473 | 3/1893 | Borgstrom | 206/39.4 |
| 1,202,691 | 10/1916 | Farrow | 206/39.1 |
| 1,656,615 | 1/1928 | Williams | 150/147 |
| 1,658,496 | 2/1928 | Quarnstrom | 206/39 |
| 2,640,347 | 6/1953 | Majeski | 70/456 |
| 2,694,921 | 11/1954 | Kerner | 70/456 |
| 3,688,896 | 9/1972 | Newell | 206/39 |
| 3,927,442 | 12/1975 | Foster | 206/37 |
| 4,141,400 | 2/1979 | Mangan | 150/147 |
| 4,202,445 | 5/1980 | Porter | 206/37 |
| 4,356,646 | 11/1982 | Johnson, Jr. | 40/16.4 |

FOREIGN PATENT DOCUMENTS

| | | | |
|---|---|---|---|
| 193345 | 11/1957 | Fed. Rep. of Germany | 40/16 |
| 7405133 | 2/1974 | Fed. Rep. of Germany . | |
| 488604 | of 1955 | Italy | 40/18 |
| 369760 | 3/1932 | United Kingdom . | |

*Primary Examiner*—Stephen Marcus
*Assistant Examiner*—David Fidel
*Attorney, Agent, or Firm*—Thomas W. Speckman; Ann W. Speckman

[57] ABSTRACT

The case (10) is for the purpose of storing credit or identification cards (K). Each card is located on its own slide (25) and each slide can be individually advanced out of the case. For this purpose, slots (15) are provided in the case, through which the tabs project which are connected to the slides. On the top of the tabs finger pads (30) are provided by means of which the slides can be moved (FIG. 5).

8 Claims, 5 Drawing Figures

CREDIT AND IDENTIFICATION CARD HOLDER

BACKGROUND OF THE INVENTION

1. Field of the Invention

Credit and identification cards are in widespread use nowadays. Their dimensions are usually standardized and the cards themselves are made of plastic. Most cards are embossed and many of them are provided with magnetic strips from which the data is erased when they are brought into contact with any magnetic metal. Cards of this type are often read electronically, for which purpose they are introduced in the slot of a reading device. In this case, the card must not be bent. This means that there is a need for a way of storin cards of this type so as to avoid bending, so that the embossed data are not damaged and so as not to erase the magnetically stored data.

2. Description of the Prior Art

U.S. Pat. No. 4,141,400 contains a description of a proposed card holder which provides protection of the above type. However, the disadvantage of this holder is that it can only contain a single card. Another holder is known from U.S. Pat. No. 3,421,658 which can accommodate a number of cards. In this holder the cards are simply stacked on top of one another. In order to take the cards out, the cover can either be opened or the uppermost card can be slid out sideways with the cover closed. The disadvantage of this arrangement is that all the cards have to be removed if the user wishes to reach the card at the bottom of the stack.

SUMMARY OF THE INVENTION

The purpose of this invention is thus to provide a holder suitable for a number of cards in which the above disadvantages are obviated. Such a holder should be capable of storing and protecting the cards which can be individually extracted from the holder as required.

This requirement is met in the present invention by a holder comprising a flat rectangular case open along one of its narrow sides, the longer sides provided with grooves in which slides for holding credit or identification cards are freely movable. The ends of the slides facing the opening have a front stop and the ends of each slide opposite the opening have rear stops and form an extending tab which is connected to a finger pad, and which projects through a slot in one of the walls of the case whereby each slide may be individually moved out of the case by movement of the finger pads over the length of the slot. The pads can be provided with a locking catch to prevent the slide being unintentionally extracted.

BRIEF DESCRIPTION OF THE DRAWINGS

One typical embodiment of the subject matter of this invention is illustrated in the drawing in which.

DESCRIPTION OF PREFERRED EMBODIMENTS

Figure 2:
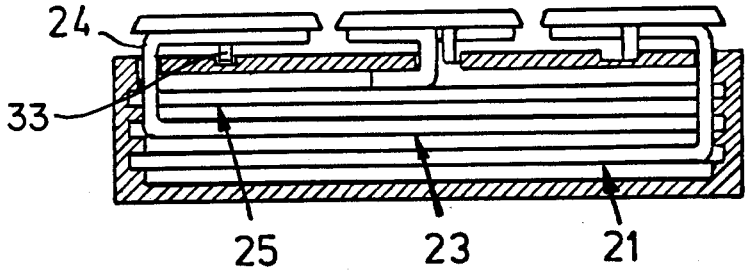
FIG. 2 shows a section of FIG. 1 along the line II—II.
Figure 1:
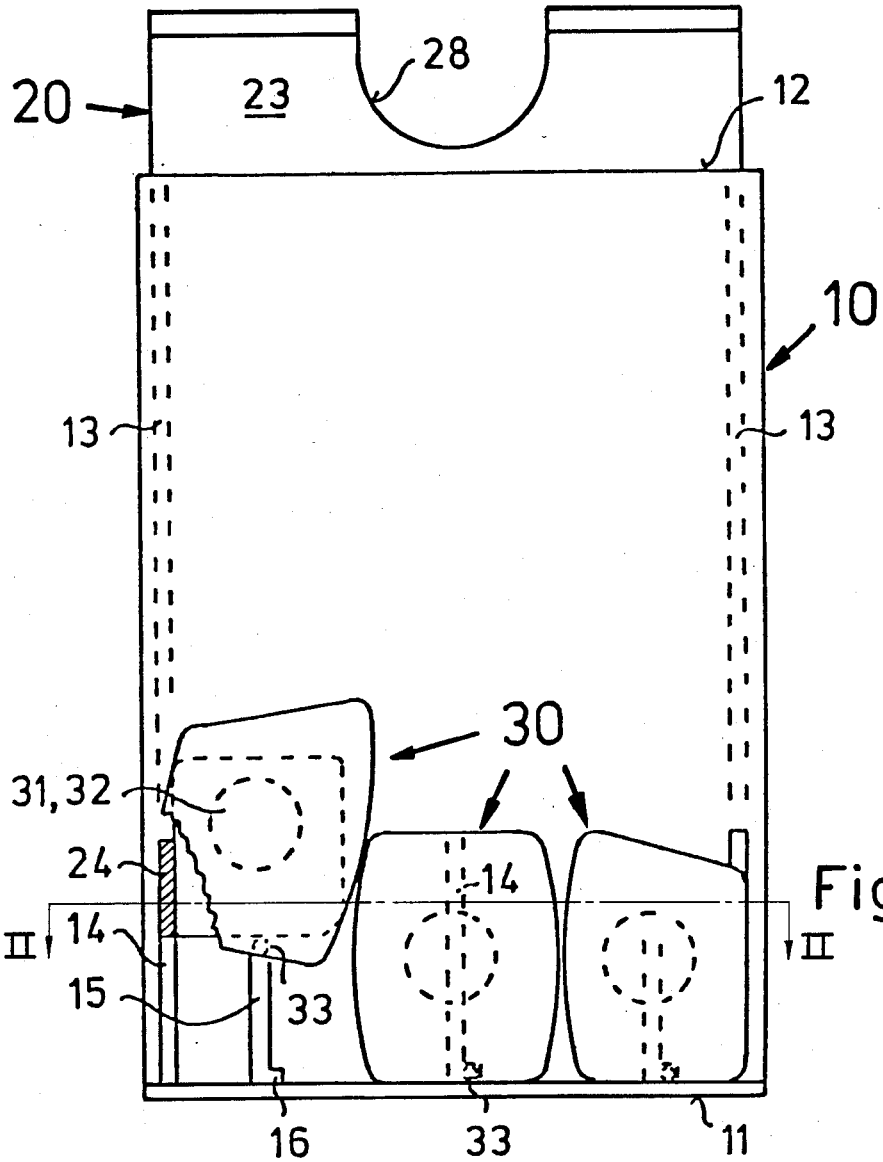
FIG. 1 shows a large scale top view of the holder provided with three slides.

A holder according to FIGS. 1 and 2 comprises a case 10 provided with three slides 20 and three finger pads 30.

The case 10 is provided with a rear wall 11 and an opening 12 from which the slides can be extracted individually with the aid of the pads. Along the narrow longitudinal sides of the case, grooves 13 are provided which serve to guide the slides. Slots 14 are provided in the wider upper wall of the case through which the tabs project which serve to actuate the slides. Grooves 15, which act as a retaining mechanism, are also provided in the upper wall of the case adjacent to the wide, outside slides.

Figure 3:
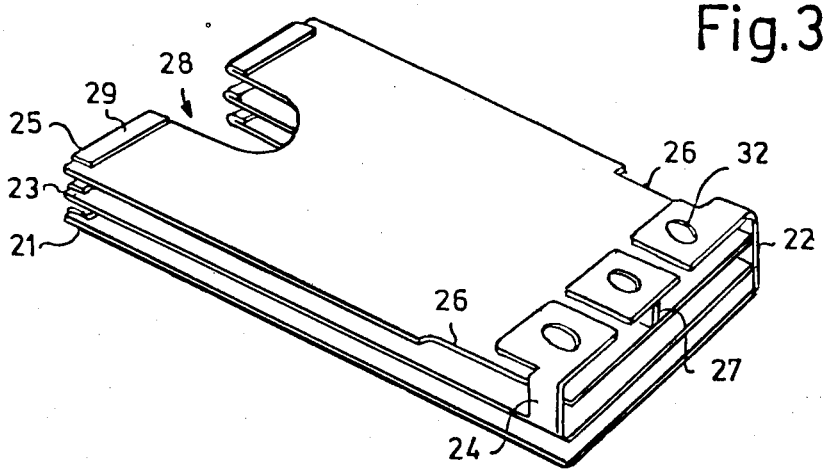
FIG. 3 shows a perspective view of three slides.
Figure 4:
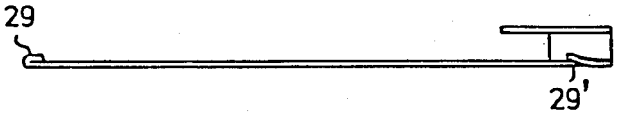
FIG. 4 shows the lateral view of a slide.

As can be seen from FIGS. 3 and 4, the three slides 20 are of slightly different configuration. The lowest slide 21 is provided with a tab 22 located at its right rear side, which projects through one of the slots 14 in the case and which is bent over parallel to it above the level of the wider wall of the case. The bent surface of this tab is provided with a round hole whose purpose will be elucidated later. The left-hand rear side of the central slide 23 is provided with a tab 24. In order to allow the slide 23 to be moved by pushing on the tab 24, the uppermost slide 25 is provided with at least one lateral cutout 26.

In order to allow the lowest slide 21 to be moved by pushing on the tab 22, the right-hand sides of slides 23 and 25 are provided with cutouts 26.

The uppermost slide 25 is provided with a central T-shaped tab 27. All the slides 21, 23 and 25 are provided with a recess for a finger 28, a front stop 29 and rear stops 29' for retaining an identification card, which can best be seen in FIG. 4.

The pads 30 are provided with a short pin 31 which enters the round hole 32 which accommodates those parts of the tabs which run parallel to the upper wall of the case. In this way, the pads are rotatably retained in hole 32 of the tab. On the rear side of each pad a latch pin 33 is provided which projects downwards. At rest, when the slide is completely retracted inside the case, these pins engage in a lateral cutout 16 at the rear end of the grooves 15 or in a lateral cutout 16 in the central slot 14. In this way, the slides are maintained at rest. The pads are retained in this location by means of a spring which is not shown here. For example, a torsion spring may be provided to rotate the pad 30 counterclockwise about its pin 31, which is rotatably retained in hole 32 of the tab.

In the retracted position of the pad, locking pin 33 moves into the lateral cutout 16 so that it can be shifted forwards only after a slight pivoting movement, as shown in FIG. 1 in the case of the left-hand pad. In FIG. 1, the left-hand pad has first of all been pivoted slightly in a clockwise direction and, as a result of its connection to tab 24, has displaced the central slide 23 slightly out of the opening 12 in the case 10. In order for the pads to be slightly rough to the feel, as wide as possible and still be pivoted, their lateral contour is slightly rounded when they are located next to one another.

It will probably be obvious that not only the top wider side of the case can be provided with the slots 14, the grooves 15 and the pads 30 all arranged together but that this sort of arrangement can also apply to the underneath wider side of the case. In this way, a total of six slides can be accommodated according to this embodiment, each of which can be fitted as described above.

Figure 5:
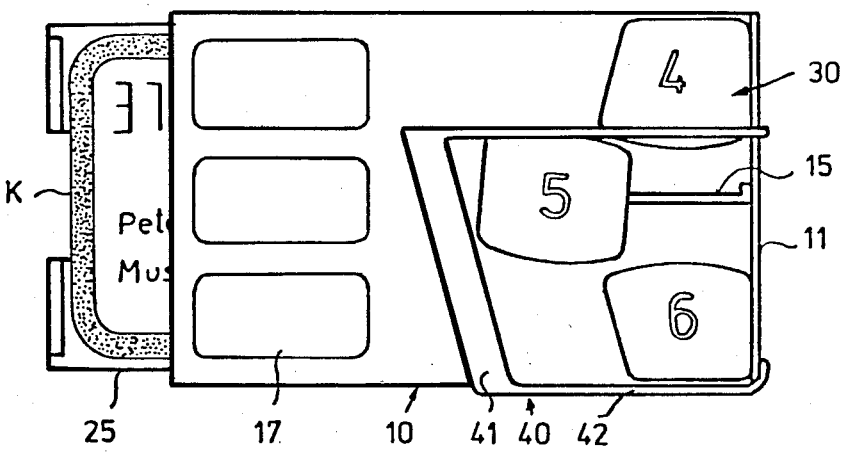
FIG. 5 shows the top view of a holder provided with clips.

A case of this type provided with six slides is shown in FIG. 5, in which the slides are numbered 1–3 on one side and 4–6 on the opposite side. One of the slides 25 has been shifted slightly out of the case 10 by means of the tab 5.

Apart from providing the tabs with numbers, labels 17 can be provided on the wide wall of the case or alternatively some other form of inscription can be used, to allow the user to identify the proper slide. In FIG. 5, the slide has moved a credit card K out of the case from which it can be easily removed thanks to the presence of the cutout 28. The holder shown in FIG. 5 is also provided with an additional clip 40 with which the holder can be clipped to the edge of a coat or jacket pocket, or fastened in a woman's handbag. This clip consists of a lateral peg 41 which is maintained against the rear wall of the holder 11 by means of elastically spring loaded rods 42.

In the embodiment of this invention described above, the slides are shifted by means of tabs which project through slots cut in the wider side of the case. This arrangement limits the capacity of the holder to six slides together with the corresponding credit or identification cards. If the tabs are however configured on the narrow side of the case, laterally in the same plane as the slides themselves, any number of cards could theoretically be accommodated in the holder. However, if room were made for too many cards, the holder would become very awkward to handle.

I claim:

1. A holder for a plurality of credit or identification cards comprising a rectangular case (10) enclosing an interior space and having an opening (12) to said interior space along at least one end, said case (10) comprising a front and a back face connected by two longitudinal side walls adjacent said opening and a rear wall (11) opposite said opening (12), wherein said longitudinal side walls are provided with a plurality of grooves (13) retaining a plurality of slides (21, 23, 25) arranged substantially parallel to one another and to said front and back faces in said interior space, each said slide is dimensioned to accommodate a credit or identification card (K), and each said slide is freely slidable in said grooves (13); the ends of said slides near said opening are provided with a front stop (29) and the ends of said slides near said end wall are provided with rear stops (29') for retaining said cards (K) on said slides; each slide is provided with a tab (22, 24, 27) extending at substantially right angles to said slide for a distance and merging into a tab portion oriented substantially parallel to said slide, said tab portion connected to a pad (30) on the exterior of said case (10) by means of pin (31); at least one said face of said case (10) is provided with a plurality of slots (14) corresponding to said pins (31), whereby each slide is individually movable from said interior space to protrude out of said opening (12) by lateral displacement of each said pad (30), and said case (10) is provided with a plurality of lateral cutouts (16) near said rear wall (11) and each said pad is provided with a latch pin (33) engageable in one of said lateral cutouts (16) to retain said slides (21, 23, 25) in said interior space and to prevent accidental displacement of each said slide.

2. A holder according to claim 1 characterized in that each said slide is provided with a finger recess (28) in its end near said opening.

3. A holder according to claim 1 characterized in that three said slides (21, 23, 25) are provided and said tab (27) of the uppermost slide (25) is arranged in a middle position between said two longitudinal side walls.

4. A holder according to claim 1 characterized in that two sets of three slides are provided, with the corresponding said pads (30) for one set of slides arranged on one said face of the case (10) and the corresponding said pads for the other set of slides arranged on the other said face of said case (10).

5. A holder according to claim 3 characterized in that two said tabs (22, 24) are provided adjacent said longitudinal side walls and cutouts (26) corresponding to said tabs are provided in the upper said slides (23, 25), whereby said tabs (22, 24) are slidable with respect to said case (10).

6. A holder according to claim 1 characterized in that a clip (40) is provided on the exterior of said case (10) to allow said case to be fastened to an article of clothing or a bag.

7. A holder according to claim 1 characterized in that said faces of the case (10) are provided with an inscription (17).

8. A holder acccording to claim 1 characterized in that said tabs which serve to move said slides project through said slots arranged in said at least one face of said case.

* * * * *